US006799804B1

(12) United States Patent
Fournier

(10) Patent No.: US 6,799,804 B1
(45) Date of Patent: Oct. 5, 2004

(54) HEATING FOOT STOOL

(76) Inventor: Bernard Fournier, 605, Monfette, St-Charles drummond, Quebec (CA), J2C 4T5

( * ) Notice: Subject to any disclaimer, the term of this patent is extended or adjusted under 35 U.S.C. 154(b) by 0 days.

(21) Appl. No.: 10/723,883

(22) Filed: Nov. 26, 2003

(51) Int. Cl.[7] ..... A47C 16/00
(52) U.S. Cl. ..... 297/423.41; 297/217.3
(58) Field of Search ..... 297/421, 423.41, 297/217.3, 180.12, 180.11, 180.1; 5/421, 423

(56) References Cited

U.S. PATENT DOCUMENTS

| | | | | | |
|---|---|---|---|---|---|
| 787,403 | A | * | 4/1905 | Sanders | 126/206 |
| D139,504 | S | * | 11/1944 | Sadler | D6/349 |
| 2,471,221 | A | * | 5/1949 | Lindstrom | 219/217 |
| 2,481,050 | A | * | 9/1949 | Eli | 219/521 |
| 2,640,205 | A | * | 6/1953 | Simpson | 5/651 |
| 2,646,578 | A | * | 7/1953 | Evans | 5/651 |
| 2,706,237 | A | * | 4/1955 | Hare et al. | 219/390 |
| 3,062,580 | A | | 11/1962 | Jasmin | |
| 3,103,219 | A | * | 9/1963 | Chadner | 607/109 |
| 3,136,577 | A | * | 6/1964 | Richard | 297/180.11 |
| 3,284,817 | A | * | 11/1966 | Landwrith | 5/647 |
| 3,296,635 | A | | 1/1967 | O'hanlan | |
| 4,071,031 | A | * | 1/1978 | Lowman | 607/114 |
| 4,072,344 | A | * | 2/1978 | Li | 297/180.1 |
| 4,708,393 | A | | 11/1987 | Fallis et al. | |
| 4,865,379 | A | * | 9/1989 | Aoki et al. | 297/180.12 |
| 4,928,335 | A | * | 5/1990 | Pedrow | 5/648 |
| 4,932,089 | A | * | 6/1990 | Laviero | 5/421 |
| 4,945,589 | A | | 8/1990 | Carey | |
| 5,120,111 | A | | 6/1992 | Cook | |
| 5,170,036 | A | * | 12/1992 | Altmann et al. | 219/217 |
| 5,333,336 | A | | 8/1994 | Langsam | |

* cited by examiner

*Primary Examiner*—Milton Nelson, Jr.

(57) ABSTRACT

A heating footstool having a hollow casing having an inclined top wall, the inclined top wall being angled relative to a ground surface so as to allow the feet of an intended user to ergonomically rest thereupon and a heating mounted within the hollow casing for heating the inclined top.

1 Claim, 3 Drawing Sheets

HEATING FOOT STOOL

FIELD OF THE INVENTION

The present invention relates generally to the field of heating equipment but more specifically to a heating foot stool.

BACKGROUND OF THE INVENTION

Numerous devices have been created to make a comfortable living environment for men and women. Air conditioning and heating systems for homes often meet this demand but because of the expensive nature of such systems and due to the fact that different individuals frequently have different desires concerning ambient conditions, several inventions have been devised to warm or cool smaller areas or spaces. A good example is an electrical heating pad, which may vary in size from about 1 sq. ft. to the size of a bed, making it a heating blanket.

In parallel, a considerable amount of work has been done on footstools, ottomans and footrests to provide different features which are comfortable or therapeutically desirable. Various features have been designed into prior footrests each having its desirable result or effect. However, no one has achieved the desirable end of producing a footrest which has a plurality of desirable effects so that they can be enjoyed in combination to achieve an improved result.

Accordingly, there exists a need for a device which would provide for both improving ambient thermal conditions and an ergonomical foot support.

SUMMARY OF THE INVENTION

Advantages of the present invention include the fact that the proposed device is adapted to ergonomically support the feet of an intended user so as to reduce overall lumbar spine stresses. The proposed footstool is specifically adapted to be positioned underneath a desk or other working space and to further provide a means for selectively heating the ambient air according to a predetermined and selectable heating pattern.

The proposed device is specifically designed so as to apply heat both to the ambient air and to the feet of the intended user in a uniform manner. The proposed device is adapted to reduce the overall energy expenditure of both commercial and residential buildings by providing an individual heating element strategically positioned so as to afford individualized ambient thermal conditions to its intended user.

The proposed device is also provided with built-in means for selectively shutting off the heating means so as to prevent energy wasting and potential heat related incidents. Still further, the proposed device is specifically designed so as to conform to conventional forms of manufacturing, be of simple construction and easy to use so as to provide a heating footrest which will be economically feasible, long lasting and relatively trouble free in operation.

BRIEF DESCRIPTION OF THE DRAWINGS

An embodiment of the present invention will now be disclosed, by way of example, in reference to the following drawings in which.

DETAILED DESCRIPTION

Figure 1:
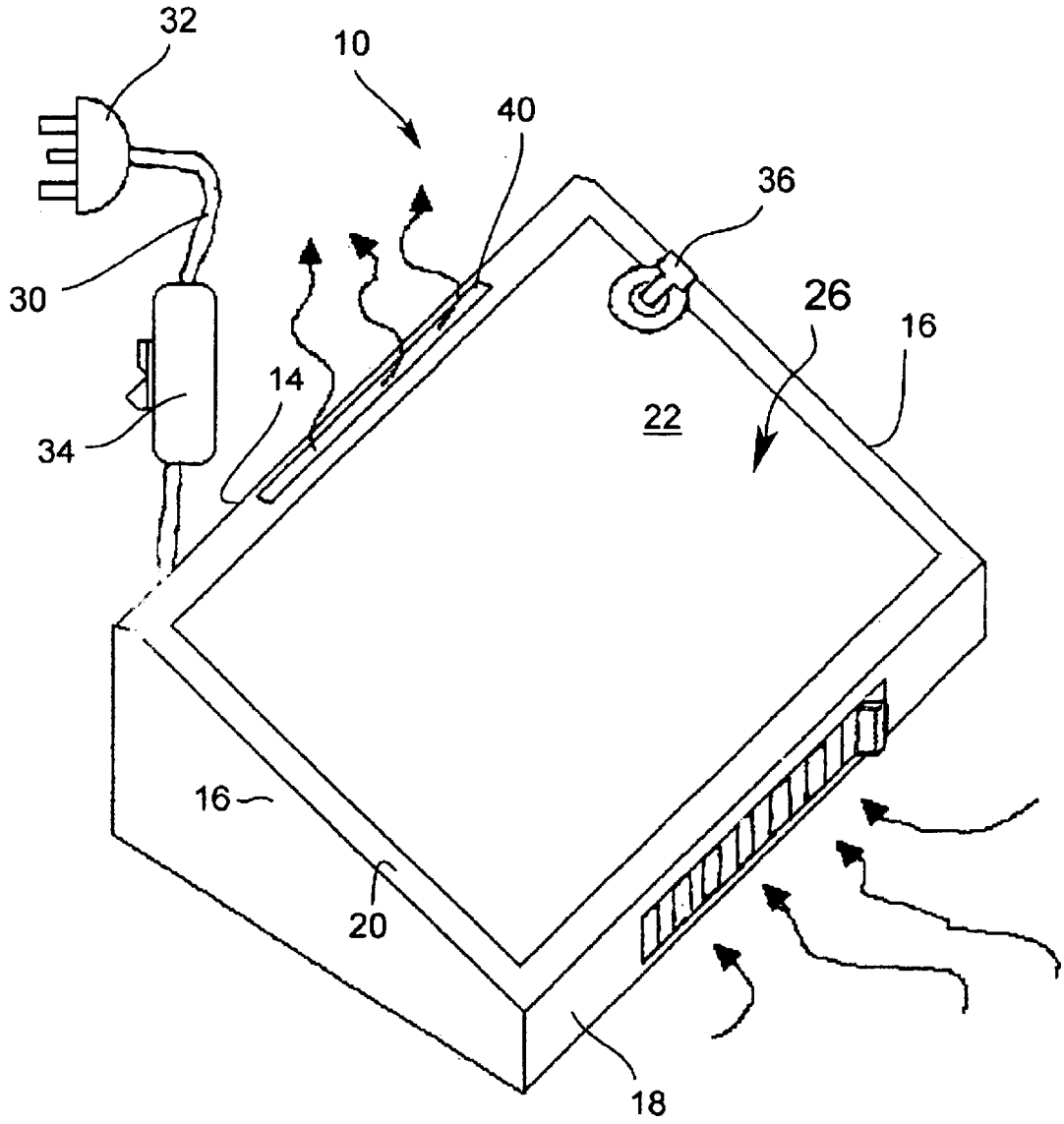
FIG. 1, in a perspective view, illustrates a heating footstool in accordance with an embodiment of the present invention having an ambient air circulation pattern schematically shown by arrows.

A heating footstool (10) has a hollow casing (26) defined by a bottom wall (12), a back wall (14), a pair of side walls (16), a frontwall (18) and a top wall (20). The side walls (16) are preferably frontwardly beveled so as to correspondingly angle the top wall (20) according to an ergonomic slope. Preferably, although by no means exclusively, the back wall (14) has a height substantially in the range of 4–¼" while the front wall (18) has a height substantially in the range of 1–½". Also, the top wall (20) preferably has a width substantially in the range of 12" and a width substantially in the range of 15".

The top wall (20) is preferably provided with a resilient pad (22). The resilient pad (22) may be formed out of any suitable material preferably having a relatively high friction coefficient. Typically, although by no means exclusively the pad (22) is made out of a suitable polymeric resin such as polyurethane foam material or the like. The outer covering could also be upholstery layer and can be in synthetic polymeric composition material or can be woven type fabric. The material must be designed so as to withstand substantial heat without creating fire hazards.

Figure 2:
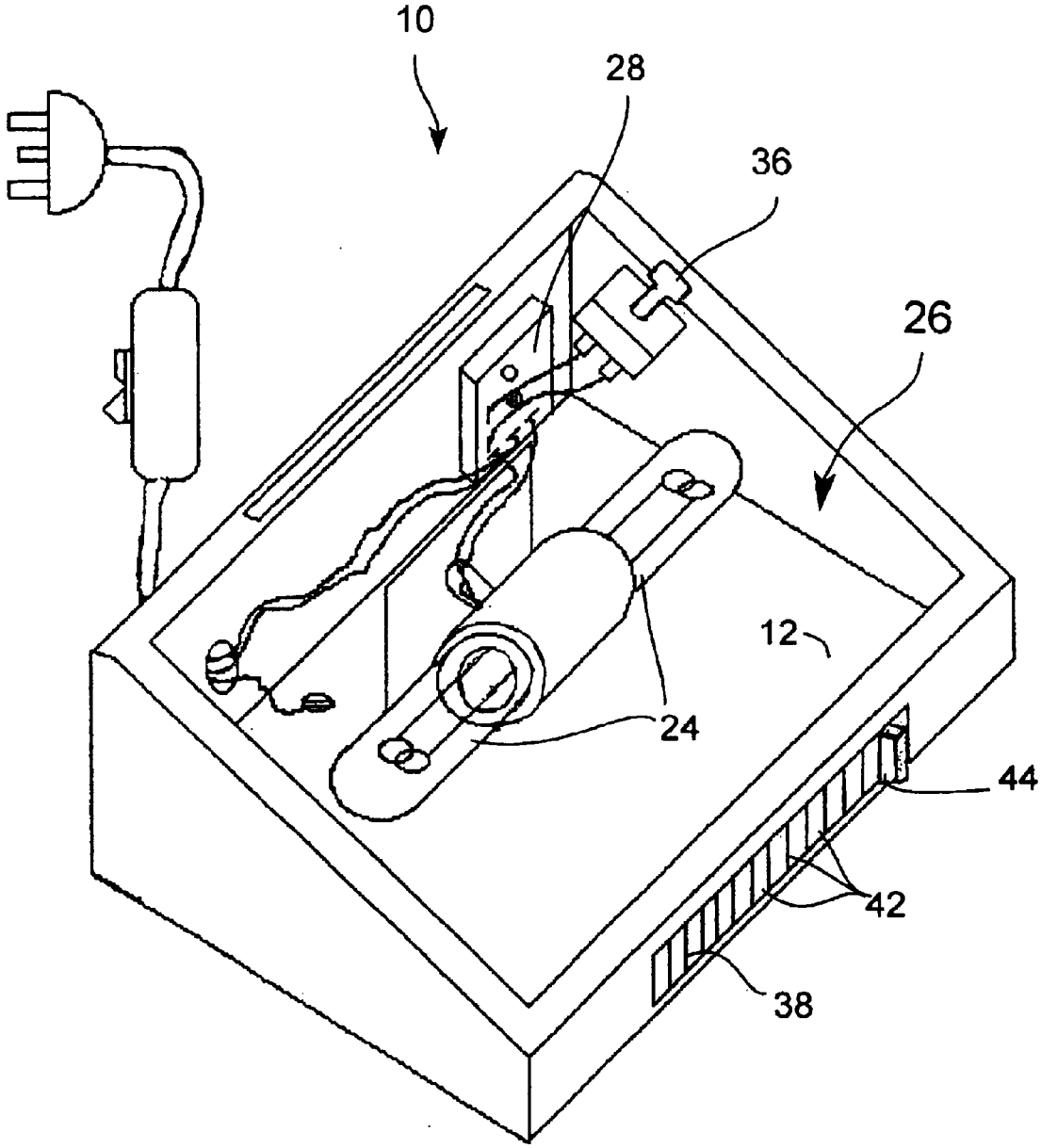
FIG. 2, in a perspective view, Illustrates the heating footstool in accordance with the present invention with its top cover removed therefrom so as to show internal components thereof including light bulbs as the heating means.
Figure 3:
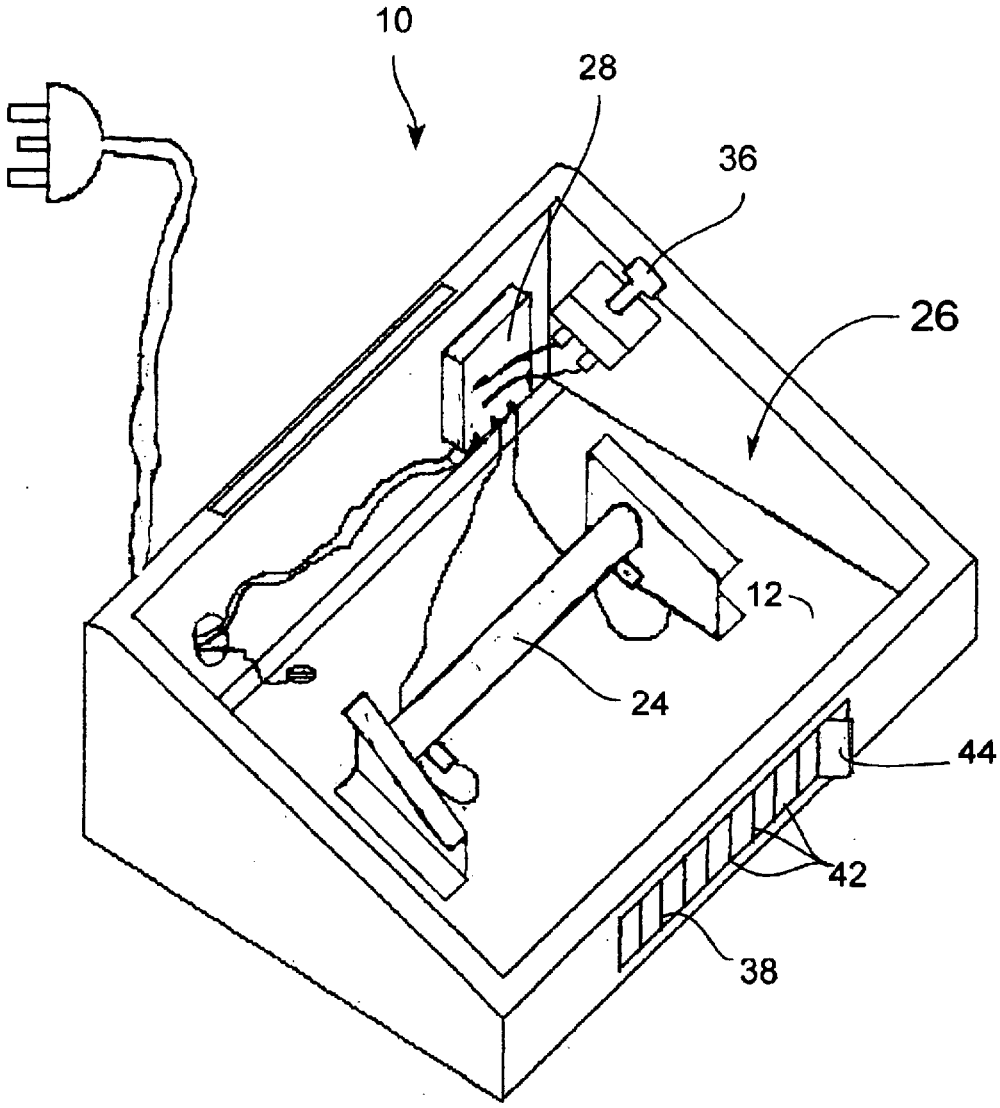
FIG. 3, in a perspective view, illustrates the heating footrest with its top cover removed therefrom wherein the heating means is an electrically resistive element and without the optional switch.

Inside the heating footstool (10) is a heating means which preferably takes the form of an electrical heating component (24) which can be either one or more light bulbs as in FIG. 2 or a electrically resistive element such as in FIG. 3. The electrical heating component (24) is electrically coupled to an electrical relay (28). The relay (28) is, in turn, electrically coupled to a suitable power cord (30) having a male type plug (32) and, optionally, a conventional switch (34) attached thereto as per FIGS. 1 and 2. Typically, although by no means exclusively, the electrical heating component (24) is adapted to provide heat between a predetermined range of temperature, for example between 35 and 50° Celsius.

A foot actuated switch (36) is preferably mounted on the top surface (20) adjacent the pad (22). The foot actuated switch (36) is also electrically coupled to the relay (28) for selectively actuating the electrical heating component (24). The electrical relay (28) is provided with a circuit adapted to provide predetermined heating patterns. For example, the electrical relay (28) may be optionally provided with a means for selectively shutting off the electrical heating component (24) after a predetermined period. The lapse of time may be selectively adjusted by an adjusting means provided within the relay (28).

The heating footstool (10) is preferably further provided with a venting means. The venting means preferably takes the form of an air inlet aperture (38) typically provided in the front wall (18) and an air outlet aperture (40) provided on an upper surface of the back wall (14) so that air entering through the air inlet aperture (38) travels through the inside of the heating footstool (10) before exiting out through the outlet aperture (40). The air inlet aperture (38) is preferably provided with a shutting means for selectively allowing and preventing through flow of air. The shutting means typically takes the form of slidable traps (42) adapted to be opened and closed using a trigger tongue (44). The heating footstool (10) may thus be used selectively for heating the feet of the intended user and also optionally for heating the ambient air traveling through both the inlet and the outlet venting apertures (38, 40).

What is claimed is:

1. A heating footstool comprising:

a hollow casing having an inclined top wall, said inclined top wall being angled relative to a ground surface so as to allow feet of an intended user to ergonomically rest thereupon;

a heating means mounted within said hollow casing for heating said inclined top wall;

said hollow casing further defining a front wall and a back wall;

said front wall and the back wall being respectively provided with an inlet aperture and an outlet aperture for allowing ambient air surrounding said hollow casing to flow through said inlet aperture into said hollow casing and then out through said outlet aperture so as to allow said ambient air to come into contact with said heating means and to allow said heated ambient air to warm the surroundings of said heating footstool;

said heating means including an electrical heating component coupled to a conventional electrical cord;

said electrical heating component being electrically coupled to an electrical relay, said electrical relay allowing said electrical heating component to be selectively activated and turned off according to a predetermined time pattern;

said electrical heating component being further coupled to a foot switch, said foot switch being operable by the foot of an intended user and positioned adjacent said top wall.

* * * * *